US008808535B2

(12) United States Patent
Niccum et al.

(10) Patent No.: US 8,808,535 B2
(45) Date of Patent: Aug. 19, 2014

(54) VACUUM DISTILLED DAO PROCESSING IN FCC WITH RECYCLE

(75) Inventors: Phillip K. Niccum, Houston, TX (US); Vasant K. Patel, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 707 days.

(21) Appl. No.: 12/813,081

(22) Filed: Jun. 10, 2010

(65) Prior Publication Data

US 2011/0303582 A1 Dec. 15, 2011

(51) Int. Cl.

*C10G 11/18* (2006.01)
*C10G 55/06* (2006.01)
*C10G 21/00* (2006.01)

(52) U.S. Cl.

CPC ..... *C10G 55/06* (2013.01); *C10G 11/18* (2013.01); *C10G 2300/1077* (2013.01); *C10G 21/003* (2013.01); *C10G 2300/807* (2013.01); *C10G 2300/308* (2013.01); *C10G 2300/302* (2013.01); *C10G 2300/301* (2013.01); *C10G 2300/4081* (2013.01); *C10G 2300/1044* (2013.01)

USPC ..... 208/113; 208/86; 208/87; 208/100

(58) Field of Classification Search

CPC . C10G 11/14; C10G 11/18; C10G 2300/1077
USPC ..... 208/87, 100, 106, 113
See application file for complete search history.

(56) References Cited

U.S. PATENT DOCUMENTS

| | | | | |
|---|---|---|---|---|
| 2,925,374 | A | 2/1960 | Gwin et al. | |
| 3,776,838 | A | 12/1973 | Youngblood et al. | |
| 4,302,323 | A | 11/1981 | Chen | |
| 4,940,529 | A * | 7/1990 | Beaton et al. | 208/61 |
| 5,076,910 | A * | 12/1991 | Rush | 208/348 |
| 5,271,826 | A * | 12/1993 | Krambeck et al. | 208/113 |
| 5,730,859 | A * | 3/1998 | Johnson et al. | 208/78 |
| 2004/0055934 | A1 | 3/2004 | Tromeur et al. | |
| 2007/0295647 | A1 | 12/2007 | Brownscombe et al. | |
| 2008/0223754 | A1 | 9/2008 | Subramanian et al. | |
| 2008/0314799 | A1 * | 12/2008 | Li et al. | 208/118 |
| 2009/0134059 | A1 | 5/2009 | Myers et al. | |
| 2009/0288985 | A1 | 11/2009 | Long et al. | |

FOREIGN PATENT DOCUMENTS

WO WO 2005/085391 * 9/2005 ..... C10G 11/18

* cited by examiner

*Primary Examiner* — Renee E Robinson
(74) *Attorney, Agent, or Firm* — Gary M. Machetta

(57) ABSTRACT

System and method for processing hydrocarbon. One or more embodiments of the method include combining a first hydrocarbon including a de-asphalted oil with a recycled hydrocarbon product to produce a combined hydrocarbon, cracking the combined hydrocarbon to produce a cracked hydrocarbon product, and recycling at least a portion of the cracked hydrocarbon product to provide the recycled hydrocarbon product, wherein the recycled hydrocarbon product comprises a cycle oil product, a naphtha product, or a combination thereof.

16 Claims, 3 Drawing Sheets

VACUUM DISTILLED DAO PROCESSING IN FCC WITH RECYCLE

BACKGROUND OF THE INVENTION

1. Field of the Invention

Embodiments of the present invention generally relate to systems and methods for upgrading hydrocarbons. More particularly, embodiments of the present invention relate to systems and methods for upgrading de-asphalted oil in a fluidized catalytic cracking unit.

2. Description of the Related Art

Conventional refinery distillation processes separate light hydrocarbon compounds from feedstocks, leaving a large volume of residual oil that is primarily heavy hydrocarbons. Solvent de-asphalting ("SDA") processes have been used to treat the heavy hydrocarbons with a solvent to generate asphaltenic and de-asphalted oil products ("DAO"). The asphaltenic and DAO products are typically treated and/or processed into useful products.

DAO can be economically attractive when downstream treatment facilities, such as hydrotreating or fluidized catalytic cracking ("FCC"), are adequately designed to process the DAO generated when treating the heavy hydrocarbons. However, hydrocracking the DAO requires a capital-intensive, high-pressure system to process the large quantity of DAO, especially when intermediate products such as diesel, gas oil, and/or kerosene are preferred.

Additionally, DAO products derived from a vacuum distillation process can be too viscous for efficient catalytic cracking in an FCC system. Furthermore, the boiling point of a significant portion of the DAO can be above normal riser-reactor operating temperatures of conventional FCC systems. This can lead to excessive production of coke, poor yield selectivity, and the potential for coke deposition on the components of the FCC system.

There is a need, therefore, for improved systems and methods for upgrading DAO in an FCC system.

BRIEF DESCRIPTION OF THE DRAWINGS

So that the recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with publicly available information and technology.

The present disclosure may provide methods and systems for processing hydrocarbon. In one or more embodiments, such a method can include combining a first hydrocarbon including a de-asphalted oil with a recycled hydrocarbon product to produce a combined hydrocarbon, cracking the combined hydrocarbon to produce a cracked hydrocarbon product, and recycling at least a portion of the cracked hydrocarbon product to provide the recycled hydrocarbon product, wherein the recycled hydrocarbon product includes a cycle oil product, a naphtha product, or a combination thereof.

Figure 1:
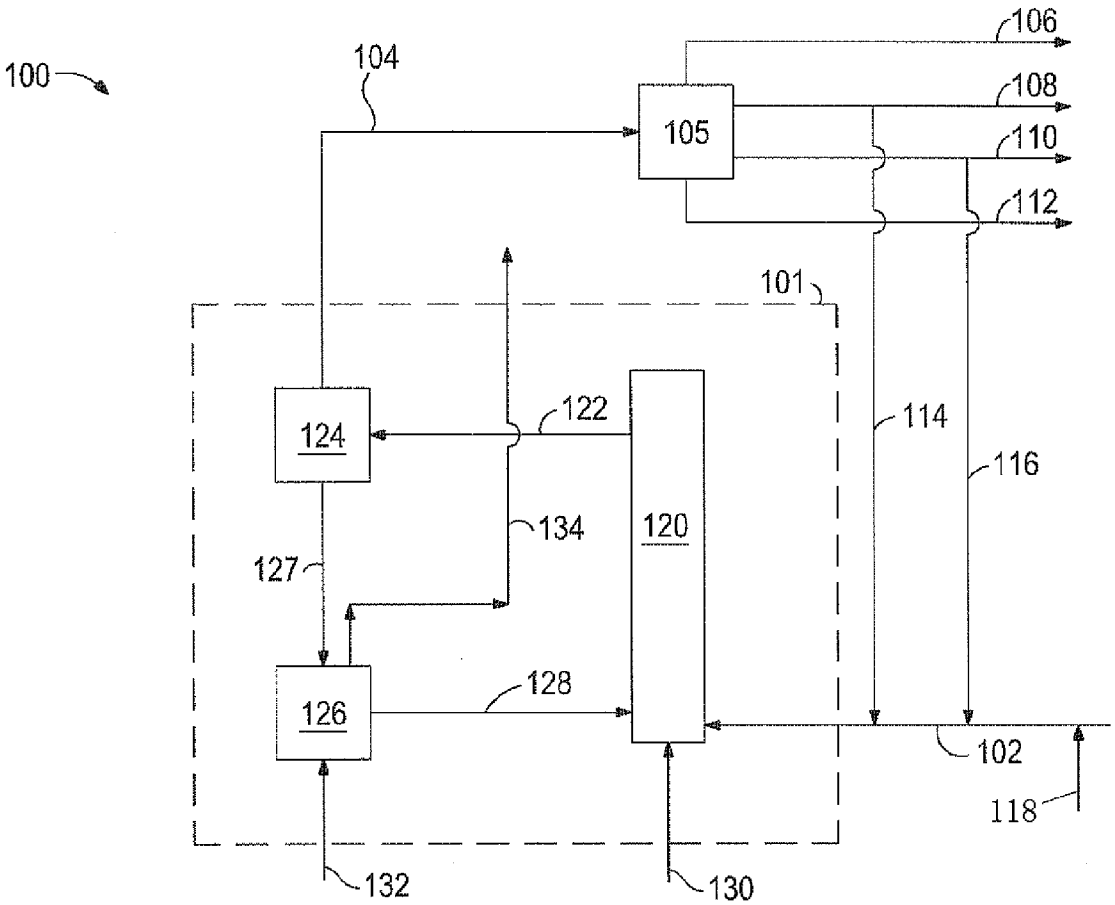
FIG. 1 depicts an illustrative fluidized catalytic cracking system, according to one or more embodiments described.

FIG. 1 depicts an illustrative catalytic cracking system 100, according to one or more embodiments. The catalytic cracking system 100 can include one or more fluidized catalytic crackers ("FCC") 101 or any other suitable system for upgrading heavy hydrocarbons. The FCC 101 can include one or more risers 120, one or more separators or separation zones 124, and one or more regenerators or regeneration zones 126.

A hydrocarbon via line 102 can be introduced to the FCC 101 to produce a hydrocarbon product mixture via line 104. The hydrocarbon in line 102 can include, but is not limited to, de-asphalted oil ("DAO"), which can be derived from atmospheric tower bottoms, vacuum tower bottoms, or a combination thereof. The hydrocarbon product mixture via line 104 can be introduced to a fractionating unit 105 to produce two or more separated hydrocarbon products. As depicted in FIG. 1, first, second, third, and fourth hydrocarbon products via lines 106, 108, 110, and 112, respectively, can be recovered from the fractionating unit 105. The fractionating unit 105 can include one or more distillation columns, strippers, settlers, pumps, condensers, and/or the like to separate the hydrocarbon product mixture in line 104 into the first, second, third, and fourth hydrocarbon products via lines 106, 108, 110, and 112, respectively.

At least a portion of one or more of the hydrocarbon products in lines 106, 108, 110, and/or 112 can be recycled to the hydrocarbon in line 102 to produce a combined hydrocarbon. For example, at least a portion of the hydrocarbon products in line 108 and line 110 can be diverted or recycled via lines 114, 116, respectively, to the hydrocarbon in line 102. Recycling at least a portion of the hydrocarbon products via line 114 and/or line 116 to the hydrocarbon in line 102 can reduce the viscosity and/or boiling point of the hydrocarbon in line 102. The hydrocarbon product recycled via line 114 and/or line 116 can be combined with the hydrocarbon in line 102, for example, using any appropriately-configured nozzles and/or mixers (not shown).

The hydrocarbon in line 102 can be more easily transported and/or can be more efficiently cracked within the FCC 101 after mixing with the hydrocarbon product via line 114 and/or line 116. For example, prior to mixing with the hydrocarbon product via line 114 and 116, the hydrocarbon in the line 102 can have a relatively high viscosity and/or a relatively high boiling point when compared to other FCC feedstocks such as hydrodesulphurised atmospheric residue. For example, the hydrocarbon in line 102 can have a sulfur content of from about 2.0 wt %, about 2.5 wt %, or about 3.0 wt %, to about 4.0 wt %, about 4.5 wt %, or about 5.0 wt %. The hydrocarbon in line 102 can also have a Conradson Carbon Residue of from about 3 wt %, about 5.0 wt %, or about 7.5 wt %, to about 9.0 wt %, about 11.5 wt %, or about 14 wt %. The hydrocarbon in line 102 can have a viscosity at 40° C. ranging from about 1,000 centiStokes ("cSt") to about 100,000 cSt, from about 5,000 cSt to about 8,500 cSt, or about 8,000 cSt. The hydrocarbon in line 102 can have an initial boiling point ("IBP") of from about 350° C. or about 375° C. to about 425° C. or about 450° C., or, for example, the IBP can be about 400° C. As the term is used herein, IBP generally refers the temperature on a distillation thermometer at the moment a first drop of distillate falls from the condenser.

Furthermore, the hydrocarbon in line 102 can have a 50 vol % distillation temperature of from about 600° C., about 625° C., or about 650° C. to about 700° C., about 725° C., or about 750° C. The hydrocarbon in line 102 can have a final boiling point ("FBP") of greater than about 750° C., about 800° C., or about 850° C. The hydrocarbon in line 102 can have a vanadium concentration of from about 5 ppmw, about 6 ppmw, or about 7 ppmw to about 9 ppmw, about 10 ppmw, or about 11 ppmw. The hydrocarbon in line 102 can have a nickel concentration of from about 0.5 ppmw, about 1.5 ppmw, or about 2.5 ppmw to about 3.5 ppmw, about 4.5 ppmw, or about 5.5 ppmw. As the term is used herein, FBP generally refers to the highest temperature reached by liquid hydrocarbon during distillation; this is, generally the temperature at which no more vapor is driven over into a condensing apparatus.

The relatively high boiling points and high viscosity of the hydrocarbon in line 102 can cause the hydrocarbon to resist atomization and/or vaporization upon introduction into the FCC 101, which can reduce the vaporization essential to the catalytic cracking reactions, thereby inhibiting yield and promoting high coke formation. Moreover, at such high viscosity, the hydrocarbon can be difficult to transport through line 102. Recycling one or more of the first, second, third, and/or fourth hydrocarbon products via lines 106, 108, 110, 112 can reduce the viscosity, partial pressure, boiling point and/or optimize other properties of the hydrocarbon in line 102.

In one or more embodiments, the first hydrocarbon product in line 106 can be a light naphtha product, the second hydrocarbon product in line 108 can be a heavy naphtha product, the third hydrocarbon product in line 110 can be a cycle oil product, and the fourth hydrocarbon product in line 112 can be a clarified oil product. In one or more embodiments, other products, in lieu of or in addition to the four hydrocarbon products in lines 106, 108, 110, and/or 112, can also be produced in the FCC 101 and/or the fractionation unit 105. Illustrative additional hydrocarbon products can include, but are not limited to. slurry oil, phenolic sour water, off-gases, and the like.

The light naphtha product in line 106 the can include hydrocarbons containing 7 or fewer carbon atoms (i.e., $C_7$ or less). The light naphtha product can have a density at about 15° C. of from about 0.5 g/cm$^3$, about 0.6 g/cm$^3$, or about 0.65 g/cm$^3$ to about 0.70 g/cm$^3$, about 0.75 g/cm$^3$, or about 0.8 g/cm$^3$. The light naphtha product can have a 10 vol % distillation temperature of from about 30° C., about 35° C., or about 40° C. to about 40° C., about 45° C., or about 50° C. The light naphtha product can have a 50 vol % distillation temperature of from about 45° C., about 50, or about 55° C. to about 60° C., about 65° C., or about 70° C. The light naphtha product can have an FBP of from about 65° C., about 70° C., or about 75° C. to about 80° C., about 85° C., or about 90° C.

The heavy naphtha product in line 108 can include hydrocarbons containing between 7 and 12 carbon atoms ($C_7$-$C_{12}$). The heavy naphtha product can have a density at about 15° C. of from about 0.6 g/cm$^3$, about 0.7 g/cm$^3$, or about 0.75 g/cm$^3$ to about 0.8 g/cm$^3$, about 0.85 g/cm$^3$, or about 0.9 g/cm$^3$. The heavy naphtha product can have a 10 vol % distillation temperature of from about 60° C., about 65° C., or about 70° C. to about 75° C., about 80° C., about 85° C., or about 90° C. The heavy naphtha product can have a 50 vol % distillation temperature of from about 105° C., about 110° C., or about 115° C. to about 120° C., about 125° C., or about 130° C. The heavy naphtha product can have an FBP of from about 195° C., about 200° C., about 205° C. to about 210° C., about 215° C., or about 220° C. The heavy naphtha product can have a cut range of from about 70° C., about 80° C., about 90° C., about 100° C., or about 110° C. to about 200° C., about 210° C., about 220° C., about 230° C., or about 240° C.

The cycle oil product in line 110 can include hydrocarbons containing between 10 and 20 carbon atoms (i.e., $C_{10}$-$C_{20}$). For example, the cycle oil product in line 110 can be or include light cycle oil, heavy cycle oil, intermediate cycle oil, slurry oil, clarified oil or decanted oil. The cycle oil product can have a density at about 15° C. of from about 0.80 g/cm$^3$, about 0.85 g/cm$^3$, or about 0.90 g/cm$^3$ to about 1.0 g/cm$^3$, about 1.05 g/cm$^3$, or about 1.10 g/cm$^3$. The cycle oil product can have an API gravity of from about 10°, about 12°, or about 13° to about 14°, about 16°, or about 18°. The cycle oil product can have a 10 vol % distillation temperature of from about 200° C., about 205° C., about 210° C. to about 220° C., about 225° C., or about 230° C. The cycle oil product can have a 50 vol % distillation temperature of from about 250° C., about 260° C., or about 270° C. to about 285° C., about 295° C., about 305° C. The cycle oil product can have an FBP of from about 350° C., about 360° C., or about 370° C. to about 380° C., about 390° C., or about 400° C. The cycle oil product can have a kinetic viscosity at 40° C. of from about 2 cSt, about 3 cSt, or about 4 cSt to about 6 cSt, about 7 cSt, or about 8 cSt.

The clarified oil product in the line 112 can include hydrocarbons containing between 12 and 30 carbon atoms ($C_{12}$-$C_{30}$). The clarified oil product can have a density at about 15° C. of from about 0.90 g/cm$^3$, about 0.95 g/cm$^3$, or about 1.0 g/cm$^3$ to about 1.10 g/cm$^3$, about 1.15 g/cm$^3$, or about 1.20 g/cm$^3$. The clarified oil product can have an API gravity of from about −8°, about −4°, or about 0° to about 4°, about 5°, or about 6°. The clarified oil product can have a 10 vol % distillation temperature of from about 250° C., about 260° C., about 270° C. to about 280° C., about 290° C., or about 300° C. The clarified oil product can have a 50 vol % distillation temperature of from about 350° C., about 375° C., or about 400° C., to about 450° C., about 475° C., or about 500° C. The clarified oil product can have an FBP of from about 600° C., about 625° C., or about 650° C. to about 700° C., about 725° C., or about 750° C. The clarified oil product can have a kinetic viscosity at 40° C. of from about 220 cSt, about 230 cSt, or about 240 cSt to about 250 cSt, about 260 cSt, or about 270 cSt. The clarified oil product can have a kinetic viscosity at 100° C. of from about 6 cSt, about 7 cSt, or about 8 cSt to about 10 cSt, about 11 cSt, or about 12 cSt.

In one or more embodiments, at least a portion of any of the hydrocarbon products in lines 106, 108, 110, 112 can be diverted to line 114 and/or line 116 for recycling and combining with the hydrocarbon in line 102, using, for example, variable flow valves, or any other suitable flow control device(s). In one or more embodiments, the catalytic cracking system 100 can include a mixer (not shown) in fluid communication with the lines 114, 116, and/or line 102 such that the diverted portion is sufficiently mixed with the hydrocarbon in line 102. In one or more embodiments, the lines 114, 116 can include spray nozzles (not shown) to facilitate mixing the hydrocarbon in line 102 with the product(s) in the lines 114, 116. In one or more embodiments, any device suitable for mixing two hydrocarbons can be used, or none can be required. In one or more embodiments, line 114 and/or line 116 can also include one or more reservoirs (not shown) for collecting the diverted portions of the hydrocarbon products, and storing therein for later use. Furthermore, in one or more embodiments, line 114 can provide the cycle oil product to the hydrocarbon via line 102, such that, after mixing, the hydrocarbon via line 102 includes from about 25 wt %, about, about 30 wt %, or about 35 wt % to about 45 wt %, about 50 wt %, or about 55 wt % light cycle oil.

In one or more embodiments, the hydrocarbon in line 102 can also be combined with steam introduced via line 118, either before or after the hydrocarbon in line 102 is combined with the recycled hydrocarbon products via line 114 and/or 116. The steam via line 118 can be provided from a boiler connected to a source of water, for example. The steam introduced via line 118 to the hydrocarbon in line 102 can reduce the hydrocarbon partial pressure of the mixture allowing the heavy oils (e.g., including the DAO in the hydrocarbon in line 102) to vaporize more completely in the FCC 101. The amount and thermodynamic state of steam introduced via line 118 can depend on the desired product yield of the FCC 101 and/or the composition, viscosity, flow rate, and/or temperature of the hydrocarbon in line 102. For example, if a lower hydrocarbon partial pressure is desired, the flow rate of the steam via line 118 can be increased. In one or more embodiments, steam can be mixed with the hydrocarbon in line 102 to provide a concentration of steam in the hydrocarbon/steam mixture ranging from about 1 wt % to about 15 wt %, or from about 5 wt % to about 10 wt %.

In general, the rate at which the steam is provided via line 118 can be increased as a carbon residue content and average boiling point of the hydrocarbon in line 102 is increased. This can minimize the production of coke, but can be balanced by the expense of more valuable liquid products. Additionally, the steam rate may be limited by other factors, such as, for example, the capacity of the various components to condense and process the resulting water in sour water processing facilities.

In one or more embodiments, the steam in line 118 can be saturated steam. The pressure of the saturated steam can range from a low of about 500 kPa, about 1,000 kPa, or about 2,000 kPa to a high of about 3,000 kPa, about 4,500 kPa, or about 6,000 kPa. In one or more embodiments, the pressure of the saturated steam can range from about 100 kPa to about 8,300 kPa, about 100 kPa to about 4,000 kPa, or about 100 kPa to about 2,000 kPa.

In one or more embodiments, the steam in line 118 can be superheated steam. The pressure of the superheated steam can be range from a low of about 500 kPa, about 1,000 kPa, or about 2,000 kPa to a high of about 3,000 kPa, about 4,000 kPa, or about 6,000 kPa. In one or more embodiments, the pressure of the superheated steam can range from about 100 kPa to about 8,300 kPa, about 100 kPa to about 4,000 kPa, or about 100 kPa to about 2,000 kPa. In one or more embodiments, the temperature of the superheated steam can be at a temperature of about 200° C., about 230° C., about 260° C., or about 290° C.

In one or more embodiments, the hydrocarbon in line 102, after mixing with the hydrocarbon products recycled via lines 114 and/or 116 and/or with the steam via line 118, can have a density at about 15° C. of from about 0.75 g/cm$^3$, about 0.85 g/cm$^3$, or about 0.95 g/cm$^3$ to about 0.98 g/cm$^3$, about 1.05 g/cm$^3$, or about 1.15 g/cm$^3$. The hydrocarbon in line 102, after mixing with the hydrocarbon products recycled via lines 114 and/or 116 and/or with the steam via line 118, can have an IBP ranging from a low of about 150° C., about 170° C., or about 190° C. to a high of about 210° C., about 230° C., or about 250° C. The hydrocarbon in line 102, after mixing with the hydrocarbon products recycled via lines 114 and/or 116 and/or with the steam via line 118, can have an 50 vol % distillation temperature of from about 400° C., about 450° C., about 500° C. to about 575° C., about 625° C., or about 675° C., or, for example, less than about 600° C. The hydrocarbon in line 102 after mixing with the hydrocarbon products recycled via lines 114 and/or 116 and/or with the steam via line 118 can have an FBP greater than about 750° C., greater than about 800° C., or greater than about 850° C.

In one or more embodiments, the hydrocarbon in line 102 after mixing with the hydrocarbon products recycled via line 114 and/or line 116 and/or with the steam via line 118, can have a temperature of from about 150° C. to about 300° C., for example, to about 200° C. or about 250° C. In one or more embodiments, the hydrocarbon in line 102 after mixing with the hydrocarbon products recycled via line 114 and/or line 116 and/or with the steam via line 118 can have a viscosity at 40° C. of from about 70 cSt to about 750 cSt. For example, in at least one embodiment, the hydrocarbon in line 102 after mixing with the hydrocarbon products recycled via lines 114 and/or 116 and/or with the steam via line 118, can have a viscosity at 40° C. of from about 80 cSt, about 90 cSt, or about 100 cSt, to about 120 cSt, about 130 cSt, or about 140 cSt. In another embodiment, the hydrocarbon in line 102 after mixing with the hydrocarbon products recycled via lines 114 and/or 116 and/or with the steam via line 118, can have a viscosity at 40° C. of from about 600 cSt, about 620 cSt, or about 640 cSt, to about 680 cSt, about 700 cSt, or about 720 cSt.

In one or more embodiments, the hydrocarbon in line 102 after mixing with the hydrocarbon products recycled via lines 114 and/or 116 and/or with the steam via line 118, can have a viscosity at 50° C. of from about 25 cSt to about 300 cSt. For example, in at least one embodiment, the hydrocarbon in line 102 after mixing with the hydrocarbon products recycled via lines 114 and/or 116 and/or with the steam via line 118, can have a viscosity at 50° C. of from about 40 cSt, about 45 cSt, or about 50 cSt, to about 55 cSt, about 60 cSt, or about 65 cSt. In at least another embodiment, the hydrocarbon in line 102 after mixing with the hydrocarbon products recycled via lines 114 and/or 116 and/or with the steam via line 118, can have a viscosity at 50° C. of from about 215 cSt, about 225 cSt, or about 235 cSt, to about 245 cSt, about 255 cSt, or about 265 cSt. The hydrocarbon in line 102 after mixing with the hydrocarbon products recycled via lines 114 and/or 116 and/or with the steam via line 118, can have a viscosity at 99° C. of from about 5 cSt, about 6 cSt, or about 7 cSt, to about 14 cSt, about 15 cSt, or about 16 cSt. The hydrocarbon in line 102 after mixing with the hydrocarbon products recycled via lines 114 and/or 116 and/or with the steam via line 118, can have a viscosity at 135° C. of from about 2 cSt, about 2.5 cSt, or about 3 cSt, to about 6 cSt, about 6.5 cSt, or about 7 cSt.

In one or more embodiments, the hydrocarbon in line 102 after mixing with the hydrocarbon products recycled via lines 114 and/or 116 and/or with the steam via line 118, can have a sulfur content of from about 1.8 wt %, about 2.0 wt %, or about 2.2 wt % to about 2.4 wt %, about 2.6 wt %, or about 2.8 wt %. The hydrocarbon in line 102, after mixing with the hydrocarbon products recycled via lines 114 and/or 116 and/or with the steam via line 118, can have Conradson Carbon Residue of from about 3.5 wt %, about 3.75 wt %, or about 4 wt % to about 5 wt %, about 5.25 wt %, or about 5.5 wt %. The hydrocarbon in line 102 after mixing with the hydrocarbon products recycled via lines 114 and/or 116 and/or with the steam via line 118, can have a vanadium content of from about 3.5 ppmw, about 3.75 ppmw, or about 4 ppmw to about 5 ppmw, about 5.25 ppmw, or about 5.5 ppmw. The hydrocarbon in line 102 after mixing with the hydrocarbon products recycled via lines 114 and/or 116 and/or with the steam via line 118, can have a nickel content of from about 1.0 ppmw, about 1.25 ppmw, or about 1.5 ppmw to about 2.0 ppmw, about 2.25 ppmw, or about 2.5 ppmw The composition of the hydrocarbon products in the recycle lines 114, 116 and/or the temperature, state, and/or rate of steam introduction via line 118 can be determined in response to the properties of the hydrocarbon in line 102. For example, to attain desired feedstock composition and/or properties, the composition and/or rate of introduction of the hydrocarbon products via line 114 and/or line 116 and the temperature, and/or rate of steam introduction via line 118, can be calculated and supplied. This in turn can result in a desired hydrocarbon product composition in line 104 and/or a desired FCC 101 yield.

The hydrocarbon products recycled via the line 114 and/or line 116 can be managed either automatically or manually. For example, the flow rate and/or composition can be altered automatically in response to signals generated by one or more sensors or an array of sensors, such as temperature and pressure gauges, coupled to a controller (not shown). Accordingly, the catalytic cracking system 100 can increase or decrease the amount of any of the hydrocarbon products introduced into the recycle lines 114 and/or 116 by controlling valves attached to any or all of the lines 106, 108, 110, 112, thereby altering the characteristics of the hydrocarbon in the recycle lines 114, 116 and affecting the yield and/or composition of the hydrocarbon products.

Referring again to the FCC 101, in one or more embodiments, steam can also be introduced via line 130 to the riser 120, thereby forming a fluidized mixture ("reaction mixture") of the steam, catalyst, and the hydrocarbon in the riser 120. The steam via line 130 can be provided from the steam in line 118 or from any other suitable source of steam. Furthermore, the steam via line 130 and the catalyst via line 128 can be fed separately to the riser 120 as shown, or the steam and the catalyst can be mixed and introduced as a mixture to the riser 120.

In one or more embodiments, the steam in line 130 can be saturated steam. The pressure of the saturated steam can range from a low of about 500 kPa, about 1,000 kPa or about 2,000 kPa to a high of about 3,000 kPa, about 4,500 kPa, or about 6,000 kPa. In one or more embodiments, the pressure of the saturated steam can range from about 100 kPa to about 8,300 kPa, about 100 kPa to about 4,000 kPa, or about 100 kPa to about 2,000 kPa.

In one or more embodiments, the steam in line 130 can be superheated steam. The pressure of the superheated steam can be range from a low of about 500 kPa, about 1,000 kPa, or about 2,000 kPa to a high of about 3,000 kPa, about 4,000 kPa, or about 6,000 kPa. In one or more embodiments, the pressure of the superheated steam can range from about 100 kPa to about 8,300 kPa, about 100 kPa to about 4,000 kPa, or about 100 kPa to about 2,000 kPa. In one or more embodiments, the temperature of the superheated steam can be at a temperature of about 200° C., about 230° C., about 260° C., or about 290° C.

In one or more embodiments, the catalyst in line 128 can include, but is not limited to one or more zeolites, faujasite zeolites, modified faujasite zeolites, Y-type zeolites, ultrastable Y-type zeolites (USY), rare earth exchanged Y-type zeolites (REY), rare earth exchanged ultrastable Y-type zeolites (REUSY), rare earth free Z-21, Socony Mobil #5 zeolite (ZSM-5), or high activity zeolite catalysts. In one or more embodiments, the catalyst-to-oil weight ratio can range from about 3:1 to about 40:1, from about 4:1 to about 25:1, or from about 6:1 to about 10:1. In one or more embodiments, the temperature of the catalyst, prior to introduction to the riser 120, can range from about 400° C. to about 815° C., about 500° C. to about 760° C., or about 650° C. to about 730° C. Although not shown, fresh or make-up catalyst can be introduced to the catalyst in line 128 and/or directly to the riser 120.

In one or more embodiments, the catalyst in line 128 can have a temperature of about 700° C. The combination of the catalyst and the heat can vaporize at least a portion of the hydrocarbon via line 102 introduced to the riser 120, thereby reducing the operating temperature in the riser to a temperature ranging from about 400° C. to about 680° C., or from about 500° C. to about 650° C. In one or more embodiments, supplemental heat and/or firing can be provided to the one or more risers 120 using waste heat provided from the one or more regeneration zones 126.

In the riser 120, the hydrocarbons within the reaction mixture can be cracked into one or more hydrocarbons and hydrocarbon by-products to provide a product mixture. In one or more embodiments, the product mixture from the riser 120 can flow via the duct 122 to the one or more separation zones 124 where the coked-catalyst particles can be separated from the product mixture, steam, and inerts. In one or more embodiments, the product mixture can be removed from the separation zone 124 via line 104. Solids, i.e., coked-catalyst particles, can fall or be directed through the separation zone discharge line 127 toward the regeneration zone 126.

The coked-catalyst particles that fall through the separation zone discharge 127 can enter the regenerator 126. In one or more embodiments, within the regeneration zone 126, the coked-catalyst particles can be combined with one or more oxidizing agents including, but not limited to, air, oxygen, oxygen-enriched air, and/or any other fluid containing one or more oxidizing agents. The one or more oxidizing agents can react with the carbonaceous matter on the coked-catalyst particles to combust or otherwise burn the carbon ("coke") off the surface of the catalyst particle. In one or more embodiments, fresh, unused, catalyst can be added via line 132 to the regeneration zone 126. The removal of the coke from the surface of the catalyst particle can re-expose the reactive surfaces of the catalyst, thereby "regenerating" the catalyst particle, permitting its reuse. Combustion by-products, such as carbon monoxide, sulfur oxides, nitrogen oxides, nitrogen oxide precursors, and carbon dioxide, can be removed from the regeneration zone 126 as a waste or flue gas via line 134.

In one or more embodiments, the regeneration zone 126 can be operated in full burn mode, partial burn mode, or anywhere in between. Operating the regeneration zone 126 in a full burn mode can provide an exhaust gas or flue gas via line 134 which can contain a larger amount of nitrogen oxides ("NOx") and NOx precursors and a decreased amount of carbon monoxide (CO) relative to the partial burn mode. Operating the regeneration zone 126 in a partial burn mode can provide an exhaust gas or flue gas via line 134 which can contain a larger amount of carbon monoxide (CO) and a lesser amount of NOx and NOx precursors relative to the full burn mode. Operating the regeneration zone 126 in between the two extremes of full burn and partial burn can provide an exhaust gas via line 134 that contains less NOx and NOx precursors and more CO when compared to the full burn mode. Operating the regeneration zone 126 in between the two extremes of full burn and partial burn can provide an exhaust gas via line 134 that contains more NOx and NOx precursors and less CO when compared to the partial burn mode. In one or more embodiments, the NOx gases can include, but are not limited to, NO, $NO_2$, and $N_2O$. In one or more embodiments, the NOx precursors can include, but are not limited to HCN, $NH_3$, CN, and HNO.

In one or more embodiments, within the regeneration zone 126 a fluidized mixture, containing substantially de-coked (i.e., "clean") catalyst particles, carbon monoxide, carbon dioxide, nitrogen oxides, and the one or more oxidizing agents can be combined with one or more optional doping agents. The dispersal and deposition of the one or more doping agents on the regenerated catalyst can be enhanced by the high temperature and turbulence present in the regeneration zone 126. In one or more embodiments, the regeneration zone 126 can operate at a temperature range ranging from about 400° C. to about 1100° C., from about 480° C. to about 1,000° C., from about 590° C. to about 900° C., or from about 650° C. to about 815° C.

In one or more embodiments, the one or more optional doping agents can be mixed with a supplemental fuel, for example natural gas, and introduced to the regeneration zone 126. The use of supplemental fuel can provide additional heat within the regeneration zone 126, further enhancing the regeneration of the coked-catalyst particles therein.

In one or more embodiments, the turbulence within the regeneration zone 126 can assist the even dispersion of the one or more doping agents within the fluidized mixture, increasing the contact between the one or more doping agents with the reactive surfaces on the regenerated catalyst. In contrast, the one or more doping agents in a traditional, homogeneously doped, catalyst are dispersed within the catalyst particles. Consequently, less doping agent can be used to achieve the same concentration of doping agent on the surface of the regenerated catalyst particle. Also, changing doping agents in response to changing process conditions and/or hydrocarbon composition can be more readily achieved since little or no entrained doping agent exists within the catalyst particle, i.e. the interior matrix of the catalyst particle. For example, the doping agent can be changed simply by changing the type and/or composition of the doping agent added to the regeneration zone 126.

In one or more embodiments, the selection of an appropriate doping agent or additive or blend of two or more doping agents or additives can be based upon the composition of the hydrocarbon introduced via line 102, and/or desired gaseous hydrocarbons in the product mixture exiting the separation zone 124 via line 104. For example, the addition of a class 2 doping agent such as magnesium or barium can preferentially increase the production of ethylene in the product mixture. The addition of a class 13 doping agent such as gallium can result in the increased production of aromatic hydrocarbons in the product mixture. The addition of class 8, 9, or 10 doping agents such as ruthenium, rhodium or palladium can preferentially increase the production of propylene in the first product mixture.

In one or more embodiments, doped catalyst particles, containing regenerated catalyst particles with or without one or more doping agents or additives can be recycled to the one or more risers 120 via line 128. In one or more embodiments, the flow of regenerated catalyst from the regeneration zone 126 can be controlled using one or more valves (not shown), which can be manually or automatically adjusted or controlled based upon parameters derived from process temperatures, pressures, flows and/or other process conditions. In one or more embodiments, at least about 90 wt %, at least about 95 wt %, at least about 99 wt %, at least about 99.99 wt %, at least about 99.9975 wt %, or at least about 99.999 wt % of the total doped catalyst originally introduced to the riser 120 via line 128 can be regenerated, optionally doped with one or more doping agents, and recycled back to the riser 120.

Although not depicted in the schematic view of FIG. 1, in one or more embodiments, the separation zone 124 can be disposed above the riser 120. In one or more embodiments, the separation zone 124 can include a separation zone discharge (not shown) which can provide fluid communication between the separation zone 124 and one or more regeneration zones 126. The separation zone 124 discharge can include one or more valves to manually or automatically adjust or control the flow of coked-catalyst particles to the regeneration zone 126 based on parameters derived from process temperatures, pressures, flows, and/or other process conditions.

Figure 2:
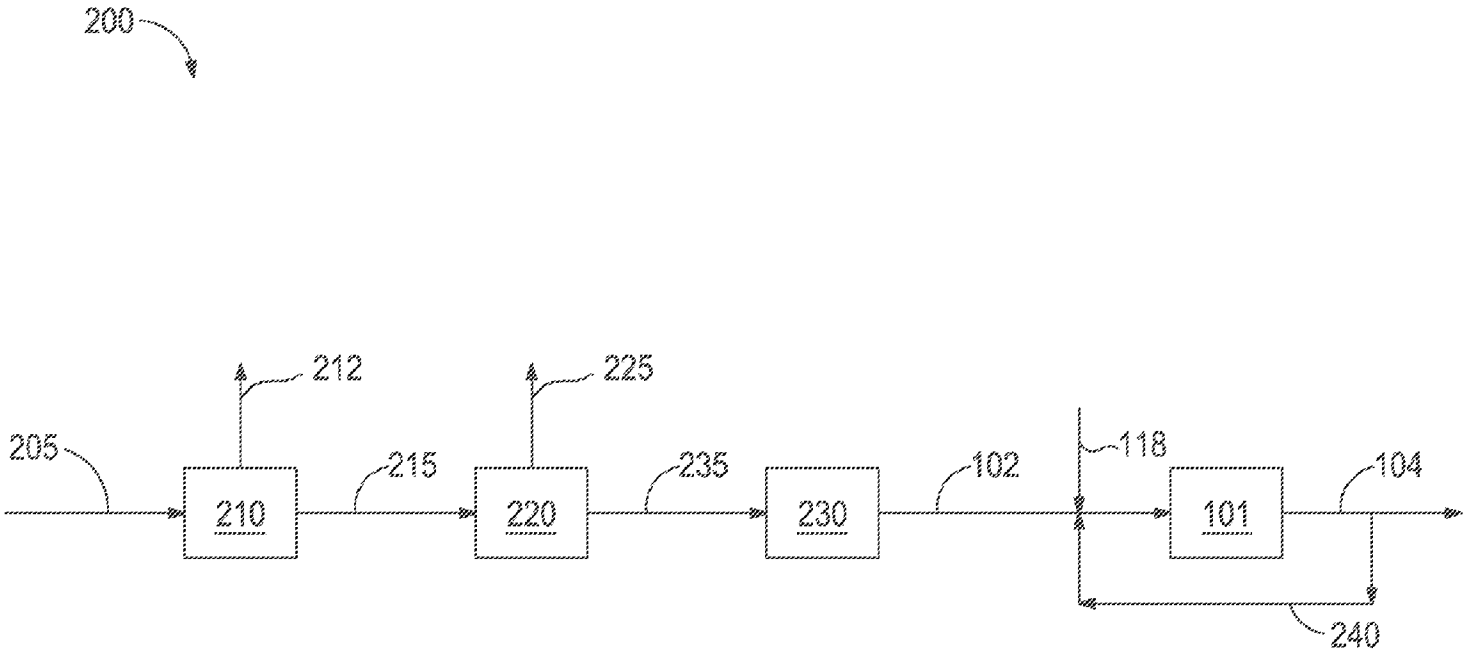
FIG. 2 depicts an illustrative hydrocarbon processing system, according to one or more embodiments described.

FIG. 2 depicts an illustrative hydrocarbon processing system 200, according to one or more embodiments. The hydrocarbon processing system 200 can include one or more distillation units (two are shown 210, 220). In one or more embodiments, the distillation unit 210 can be an atmospheric distillation unit ("ADU") and the distillation unit 220 can be a vacuum distillation unit ("VDU") 220. The hydrocarbon processing system 200 can also include one or more solvent extraction systems 230, for example, a two-stage solvent extraction system, which can be as discussed and described below with reference to FIG. 3. The hydrocarbon processing system 200 can further include the FCC 101, which can be substantially as described above with reference to FIG. 1.

One or more hydrocarbons can be introduced into the hydrocarbon treatment system 200 via line 205 for refinement therein. The hydrocarbons in line 205 can contain one or more $C_1$-$C_{100}$ compounds. For example, the hydrocarbons in line 205 can include, but are not limited to, asphaltenes, naphthenes, aromatic hydrocarbons, and paraffinic hydrocarbons. The hydrocarbons in line 205 can have an asphaltene concentration of about 5 wt % or more, about 10 wt % or more, about 15 wt % or more, about 20 wt % or more, about 25 wt % or more, or about 30 wt % or more. The hydrocarbons in line 205 can have a naphthenes concentration ranging from about 5 wt % to about 25 wt %, about 10 wt % to about 20 wt %, or about 13 wt % to about 18 wt %. The hydrocarbons in line 205 can have an aromatics concentration ranging from about 5 wt % to about 25 wt %, about 10 wt % to about 20 wt %, or about 13 wt % to about 18 wt %. The hydrocarbons in line 205 can have a paraffins concentration ranging from about 50 wt % to about 85 wt %, about 60 wt % to about 75 wt %, or about 63 wt % to about 70 wt %. The one or more hydrocarbons in line 205 can also include one or more heavy metals, including, but not limited to, nickel and/or vanadium. The hydrocarbons in line 205 can have a nickel concentration of about 25 ppmw or more, about 50 ppmw or more, about 100 ppmw or more, about 200 ppmw or more, or about 400 ppmw or more. The hydrocarbons in line 205 can have a vanadium concentration of about 125 ppmw or more, about 250 ppmw or more, about 500 ppmw or more, about 750 ppmw or more, or about 1,000 ppmw or more.

The one or more hydrocarbons in line 205 can include one or more inert materials, for example sands, shales, clays, silts, or any combination thereof. In one or more embodiments, the concentration of inert materials can range from a low of about 1 wt %, about 2 wt %, about 5 wt %, or about 10 wt %; to a high of about 35 wt %, about 40 wt %, about 50 wt %, or about 70 wt %. The one or more hydrocarbons in line 205 can include one or more oil shales. The one or more hydrocarbons in line 205 can include one or more tar sands saturated with bitumen. In one or more embodiments, the one or more hydrocarbons in line 205 can have a bitumen concentration ranging from about 1 wt % to about 30 wt %, about 3 wt % to about 25 wt %, about 5 wt % to about 21 wt %, or about 8 wt % to about 15 wt %. In one or more embodiments, bitumen contained in the one or more hydrocarbons in line 205 can have a maximum sulfur content of about 2 wt %, about 3 wt %, about 4 wt %, about 5 wt %, or about 6 wt %. In one or more embodiments, the bitumen contained in the crude hydrocarbons in line 205 can have a maximum aromatics content of about 20 wt %, about 25 wt %, about 30 wt %, about 35 wt %, or about 40 wt %.

The hydrocarbons can be introduced via line 205 to the one or more distillation units 210, 220. For example, the hydrocarbons via line 205 can be first introduced to the ADU 210. The ADU 210 can be any atmospheric distillation unit suitable for separating the hydrocarbon in line 205 into two or more fractions or products. The ADU 210 can heat all or a portion of the one or more hydrocarbons in line 205, at generally ambient pressure conditions, to between about 300° C. and about 500° C., for example to about 400° C., thereby separating the hydrocarbon in a distillation column into a vaporized portion ("ADU product") and a residual liquid portion ("ADU residue").

The ADU product can be recovered via line 212. The ADU product in line 212 can be further processed, for example, fractionated, to provide two or more products. The ADU residue via line 215 can be introduced to the VDU 220. The ADU product in line 215 can contain a mixture of one or more hydrocarbons, for example, one or more light naphthas and/or one or more heavy naphthas. The ADU residue via line 215 can contain a mixture of one or more hydrocarbons including any concentration of $C_{16}$-$C_{100}$ hydrocarbons In one or more embodiments, the VDU 220 can be any vacuum distillation unit suitable for separating the hydrocarbon in line 205 into two or more fractions or products. For example, the VDU 220 can be configured to further distill the ADU residue via line 215 from the ADU 210. The VDU 220 can apply a reduced pressure to the ADU residue, increasing the volatility thereof, and can heat the ADU residue. The VDU 220 can thereby vaporize a portion of the ADU residue at temperatures below the atmospheric boiling point of the portion of the ADU residue. Accordingly, the VDU 220 can separate the ADU residue into the vaporized portion ("VDU product") and a residual portion ("VDU residue").

The VDU product can be recovered via line 225 and can be further processed, for example fractionated to provide two or more products. All or a portion of the VDU residue in line 235 can be introduced to the solvent extraction system 230. In one or more embodiments, the VDU product in line 225 can be a mixture containing one or more $C_2$ to $C_{20}$ hydrocarbon compounds, for example, one or more light naphthas and/or one or more heavy naphthas.

The VDU residue directed into the solvent extraction system 230 via line 235 can include $C_5$ and heavier hydrocarbons, asphaltenes, organo-metallic compounds, organo-sulfur compounds, mixtures thereof, derivatives thereof, or any combination thereof, and/or like compounds. In one or more embodiments, the VDU residue in line 235 can have an asphaltenic hydrocarbon concentration ranging from a low of about 1 wt %, about 5 wt %, or about 10 wt %, to a high of about 40 wt %, about 50 wt %, or about 60 wt %.

The hydrocarbon produced by the solvent extraction system 230 via line 102 can be mixed with steam introduced via line 118, as described above with reference to FIG. 1. The FCC 101 can catalytically crack the hydrocarbon in line 102 to produce the one or more products, as described above. The hydrocarbon produced by the FCC 101 can exit the hydrocarbon processing system 200 via line 102. At least a portion of the hydrocarbon products, however, can be diverted or recycled via line 240 back to the line 102, such that the diverted hydrocarbon products can mix with the hydrocarbon in line 102, as described above. In one or more embodiments, although not shown, hydrocarbon products from other systems or processes can be mixed with to supplement, or used in lieu of, the hydrocarbon products recycled via line 240.

Figure 3:
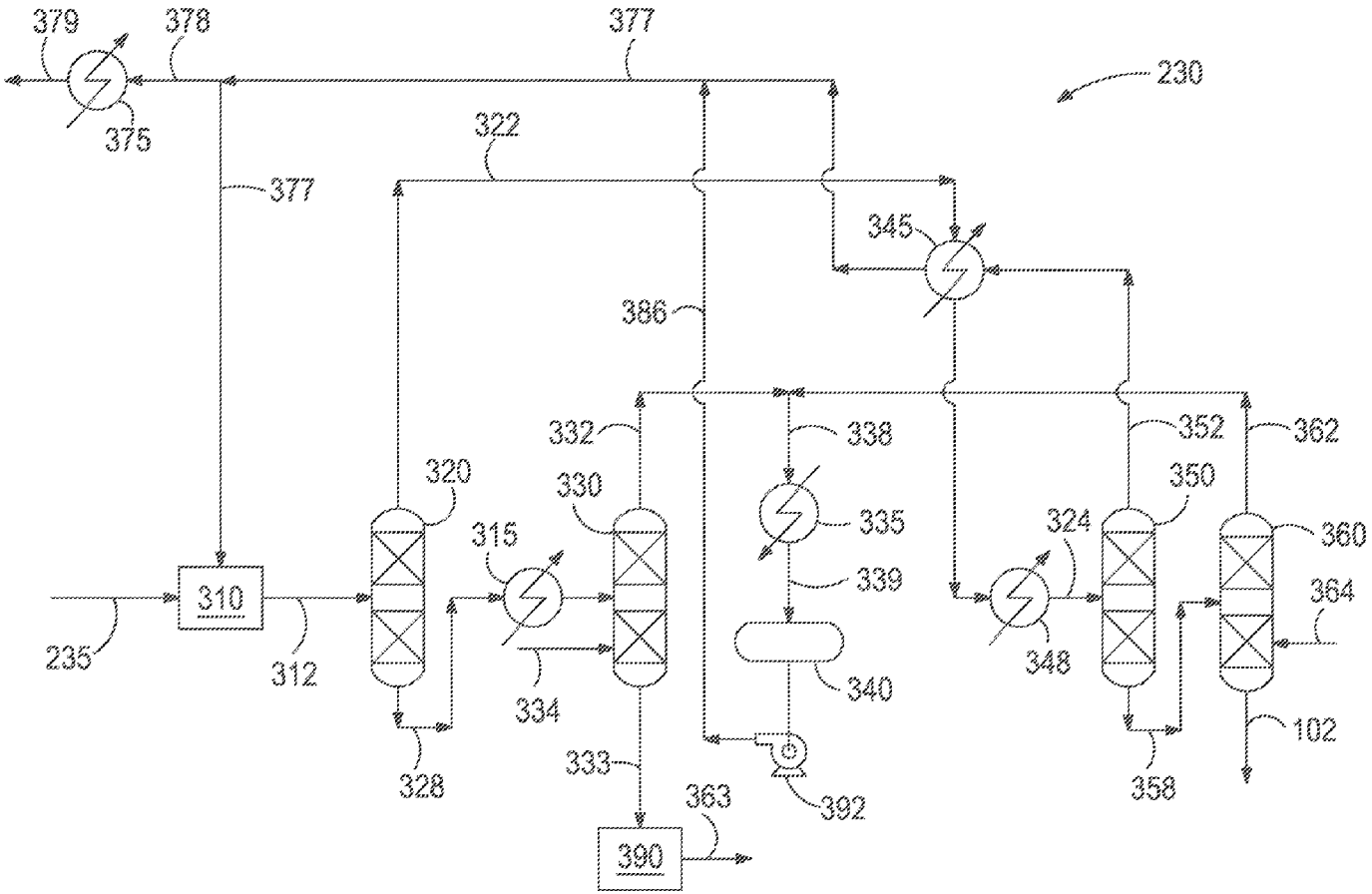
FIG. 3 depicts an illustrative solvent extraction system, according to one or more embodiments described.

FIG. 3 depicts an illustrative solvent extraction system 230 in accordance with one or more embodiments. The solvent extraction system 230 can also be known as a solvent deasphalting system or a residual oil supercritical extraction unit. In one or more embodiments, the solvent extraction system 230 can remove an asphaltenic hydrocarbon portion from the VDU residue. As used herein, the terms "asphaltene," "asphaltenes," "asphaltenic hydrocarbon," and "asphaltenic hydrocarbons" can refer to one or more hydrocarbons that are insoluble in n-alkanes but are at least partially soluble in aromatics such as benzene and/or toluene. Asphaltenes can consist primarily of carbon, hydrogen, nitrogen, oxygen, and sulfur, as well as trace amounts of vanadium and nickel. Asphaltenes can have a carbon-to-hydrogen ("C:H") ratio of about 1:2, about 1:1.5, about 1:1.2, or about 1:1. In one or more embodiments, asphaltenes can be an n-heptane ($C_7H_{16}$) insoluble and toluene ($C_6H_5CH_3$) soluble component of a carbonaceous material such as crude oil, bitumen or coal. In one or more embodiments, asphaltenes can have a molecular mass distribution in the range ranging from about 400 u to about 1500 u.

In one or more embodiments, the solvent extraction system 230 can be provided substantially as described in U.S. Pat. No. 7,347,051, the entirety of which is hereby incorporated herein by reference to the extent it is not inconsistent with this disclosure. In one or more embodiments, the solvent extraction system 230 can be a two-stage solvent extraction system 230; however, solvent extraction systems 230 including three or more stages or a single stage are within the scope of this disclosure.

In one or more embodiments, the two-stage solvent extraction system 230 can include one or more mixers 310, separators 320, 350, and strippers 330, 360. Any number of mixers, separators, and strippers can be used depending on the amount of the hydrocarbon to be processed.

In one or more embodiments, VDU residue via line 235 can be mixed or otherwise combined with a solvent introduced via line 377. As used herein, the terms "solvent" and "solvents" can refer to one or more alkane or alkene hydrocarbons having three to seven carbon atoms ($C_3$ to $C_7$), mixtures thereof, derivatives thereof and combinations thereof. In one or more embodiments, the solvent can have a normal boiling point (for pure solvents) or bulk normal boiling point (for solvent mixtures) of less than 538° C. In one or more embodiments, the solvent can be an n-butane solvent.

The VDU residue and solvent can be mixed or otherwise combined within the one or more mixers 310 to provide a hydrocarbon mixture via line 312. The solvent-to-hydrocarbon weight ratio can vary depending upon the physical properties and/or composition of the hydrocarbon. For example, the solvent-to-hydrocarbon mixture can have a volumetric dilution ratio ranging from about 4:1 to about 12:1, about 7:1 to about 9:1, or about 8:1.

The one or more mixers 310 can be one or more systems, devices, or combination of systems and/or devices suitable for batch, intermittent, and/or continuous mixing of the hydrocarbon and the solvent. The mixer 310 can be capable of homogenizing immiscible fluids. Illustrative mixers can include but are not limited to ejectors, inline static mixers, inline mechanical/power mixers, homogenizers, or combinations thereof. The mixer 310 can operate at temperatures of about 25° C. to about 600° C., about 25° C. to about 500° C., or about 25° C. to about 300° C. The mixer 310 can operate at a pressure slightly higher than the pressure of the separator 320. In one or more embodiments, the mixer can operate at a pressure of about 101 kPa to about 2,100 kPa above the critical pressure of the solvent ("$P_{C,S}$"), about $P_{C,S}$−700 kPa to about $P_{C,S}$+2,100 kPa, about $P_{C,S}$−500 kPa to about $P_{C,S}$+1,500 kPa, about $P_{C,S}$−300 kPa to about $P_{C,S}$+700 kPa.

The hydrocarbon mixture in line 312 can be introduced to the one or more separators ("asphaltene separators") 320 to provide a de-asphalted oil mixture via line 322 and an asphaltenic mixture via line 328. The DAO mixture in line 322 can contain de-asphalted oil and a first portion of the solvent. The asphaltenic mixture in line 328 can contain insoluble asphaltenes and the balance of the solvent. In one or more embodiments, the DAO concentration in line 322 can range from about 1 wt % to about 50 wt %, about 5 wt % to about 40 wt %, or about 14 wt % to about 34 wt %. In one or more embodiments, the solvent concentration in line 322 can range from about 50 wt % to about 99 wt %, about 60 wt % to about 95 wt %, or about 66 wt % to about 86 wt %. In one or more embodiments, the API gravity of the DAO mixture in line 322 can range from about 10° to about 100°, about 30° to about 100°, or about 50° to about 100°.

In one or more embodiments, the asphaltenic mixture in line 328 can have an asphaltene concentration ranging from about 10 wt % to about 99 wt %, about 30 wt % to about 95 wt %, or about 50 wt % to about 90 wt %. In one or more embodiments, the asphaltenic mixture in line 328 can have a solvent concentration ranging from about 1 wt % to about 90 wt %, about 5 wt % to about 70 wt %, or about 10 wt % to about 50 wt %.

The one or more separators 320 can include one or more systems, devices, or combination of systems and/or devices suitable for separating one or more asphaltenes from the hydrocarbon and solvent mixture to provide de-asphalted oil via line 322 and asphaltenes via line 328. In one or more embodiments, the one or more separators 320 can contain one or more internal structures including bubble trays, packing elements such as rings or saddles, structured packing, or combinations thereof. In one or more embodiments, the one or more separators 320 can be an open column without internals. In one or more embodiments, the one or more separators 320 can be one or more partially empty columns containing one or more internal structures. In one or more embodiments, the separators 320 can operate at a temperature of about 15° C. to about 150° C. above the critical temperature of the one or more solvent ("$T_{C,S}$"), about 15° C. to about $T_{C,S}$+100° C., or about 15° C. to about $T_{C,S}$+50° C. In one or more embodiments, the separators 320 can operate at a pressure of about 101 kPa to about 2,100 kPa above the critical pressure of the solvent ("$P_{C,S}$"), about $P_{C,S}$−700 kPa to about $P_{C,S}$+2,100 kPa, about $P_{C,S}$−500 kPa to about $P_{C,S}$+1,500 kPa, about $P_{C,S}$−300 kPa to about $P_{C,S}$+700 kPa.

In one or more embodiments, the asphaltenes in line 328 can be heated using one or more heat exchangers 315, prior to introduction to the one or more strippers 330. In one or more embodiments, the asphaltenes in line 328 can be heated to a temperature of about 100° C. to about $T_{C,S}$+150° C., about 150° C. to about $T_{C,S}$+100° C., or about 300° C. to about $T_{C,S}$+50° C. using one or more heat exchangers 315.

The one or more heat exchangers 315 can include one or more systems, devices, or combination of systems and/or devices suitable for increasing the temperature of the asphaltenes in line 328. Illustrative heat exchanger systems or devices can include shell-and-tube exchangers, plate and frame exchangers, spiral wound exchangers, or any combination thereof. In one or more embodiments, a heat transfer medium such as steam, hot oil, hot process fluids, electric resistance heat, hot waste fluids, or combinations thereof can be used to transfer heat to the asphaltenes in line 328. In one or more embodiments, the one or more heat exchangers 315 can be a direct fired heater or the equivalent. In one or more embodiments, the one or more heat exchangers 315 can operate at a temperature of about 25° C. to about $T_{C,S}$+150° C., about 25° C. to about $T_{C,S}$+100° C., or about 25° C. to about $T_{C,S}$+50° C. In one or more embodiments, the one or more heat exchangers 315 can operate at a pressure of about 101 kPa to about $P_{C,S}$+2,100 kPa, about 101 kPa to about $P_{C,S}$+1,500 kPa, or about 101 kPa to about $P_{C,S}$+700 kPa.

Within the stripper 330, the solvent in the asphaltenes in line 328 can be selectively separated to provide a recovered solvent via line 332 and asphaltenes ("asphaltene product") via line 333. In one or more embodiments, the recovered solvent in line 332 can contain a first portion of the solvent and small quantities of residual DAO, and the asphaltenes in line 333 can contain a mixture of insoluble asphaltenes and the balance of the solvent. In one or more embodiments, the recovered solvent in line 332 can have a solvent concentration ranging from a low of about 50 wt %, about 70 wt %, or about 80 wt % to a high of about 90 wt %, about 95 wt %, about 99 wt %, or more. In one or more embodiments, the recovered solvent in line 332 can contain less about 5 wt %, less than about 3 wt %, less than about 1 wt %, or less than about 0.5 wt % DAO. In one or more embodiments, the asphaltene product in line 333 can have an asphaltene concentration ranging from a low of about 20 wt %, about 40 wt %, or about 50 wt % to a high of about 75 wt %, about 80 wt %, about 95 wt %, or more.

In one or more embodiments, steam, for example saturated or superheated, can be injected into the one or more strippers 330 via line 334 to further enhance the separation of the asphaltenes from the solvent. In one or more embodiments, the steam in introduced to the one or more strippers 330 via line 334 can be at a pressure ranging from about 200 kPa to about 2,160 kPa, from about 300 kPa to about 1,375 kPa, or from about 400 kPa to about 1,130 kPa.

In one or more embodiments, the asphaltene product in line 333 can have a solvent concentration ranging from a low of about 1 wt %, about 5 wt %, about 10 wt %, or about 20 wt %, to a high of about 50 wt %, about 60 wt %, about 70 wt %, or about 80 wt %. In one or more embodiments, the API gravity of the asphaltene product in line 133 can range from a low of about −15°, about −10°, or about −5° to a high of about 5°, about 10°, or about 15° or more. In one or more embodiments, at least a portion of the asphaltene product in line 333 can be dried and pelletized. In one or more embodiments, at least a portion of the asphaltene product in line 333 can be gasified to provide one or more gas products for power generation, process heating, or combinations thereof. In one or more embodiments, at least a portion of the asphaltene product in line 333 can be combusted or otherwise converted to provide steam, mechanical power, electrical power, or any combination thereof.

The one or more strippers 330 can include one or more systems, devices, or combination of systems and/or devices suitable for selectively separating the asphaltenes in line 328 to provide the recovered solvent via line 332 and the asphaltene product via line 333. In one or more embodiments, the one or more strippers 330 can contain one or more internal structures including bubble trays, packing elements such as rings or saddles, structured packing, or combinations thereof. In one or more embodiments, the one or more strippers 330 can be an open column without internals. In one or more embodiments, the one or more strippers 330 can be one or more partially empty columns containing one or more internal structures. In one or more embodiments, the one or more strippers 330 can operate at a temperature of about 30° C. to about 600° C., about 100° C. to about 550° C., or about 300° C. to about 550° C. In one or more embodiments, the one or more strippers 330 can operate close to zero pressure, for example at about 0.1 kPa. In one or more embodiments, the one or more strippers 330 can operate at a pressure ranging from a low of about 30 kPa, about 100 kPa, about 500 kPa, or about 1,000 kPa to a high of about 2,500 kPa, about 3,300 kPa, about 4,000 kPa, or about 4,500 kPa.

Referring again to the one or more asphaltene strippers 320, the DAO mixture in line 322 exiting the one or more asphaltene strippers 320, can be heated using one or more heat exchangers 345, 348 to provide a heated DAO mixture via line 324. In one or more embodiments, the temperature of the heated DAO mixture in line 324 can be increased above the critical temperature of the solvent $T_{C,S}$. In one or more embodiments, the heated DAO mixture in line 324 can have a temperature ranging from about 25° C. to about $T_{C,S}$+150° C., about $T_{C,S}$−100° C. to about $T_{C,S}$+100° C., or about $T_{C,S}$−50° C. to about $T_{C,S}$+50° C.

The one or more heat exchangers 345, 348 can include one or more systems, devices, or combination of systems and/or devices suitable for increasing the temperature of the DAO mixture in line 322. In one or more embodiments, the heat exchanger 345 can be a regenerative type heat exchanger using a high temperature process stream to heat the DAO mixture in line 322 prior to introduction to the separator 350. In one or more embodiments, a recovered solvent can be introduced via line 352 to the heat exchanger 345 to heat the DAO mixture introduced via line 322. In one or more embodiments, the one or more heat exchangers 345, 348 can operate at a pressure of about 101 kPa to about $P_{C,S}$+2,100 kPa, about 101 kPa to about $P_{C,S}$+1,500 kPa, or about 101 kPa to about $P_{C,S}$+700 kPa.

The heated DAO mixture via line 324 can be introduced to the one or more separators 350 and selectively separated therein to provide a recovered solvent via line 352 and a concentrated DAO mixture via line 358. In one or more embodiments, the recovered solvent in line 352 can contain a first portion of the solvent, and the concentrated DAO mixture in line 358 can contain DAO and the balance of the solvent. In one or more embodiments, the recovered solvent in line 352 can have a solvent concentration ranging from a low of about 50 wt %, about 70 wt %, or about 85 wt % to a high of about 95 wt %, about 98%, about 99%, or more, with the balance being DAO. In one or more embodiments, in the concentrated DAO mixture in line 358 can have a DAO concentration ranging from a low of about 20 wt %, 40 wt %, or about 50 wt % to a high of about 80 wt %, about 90 wt %, about 95 wt %, or more, with the balance being the solvent. In one or more embodiments, the DAO mixture in line 358 can have an API gravity ranging from a low of about 5°, about 10°, or about 12° to a high of about 20°, about 25°, about 30°, or more.

The one or more separators 350 can include one or more systems, devices, or combination of systems and/or devices suitable for separating the DAO mixture introduced via line 322 to provide the recovered solvent in line 352 and the concentrated DAO mixture in line 358. In one or more embodiments, the one or more separators 350 can contain one or more internal structures including bubble trays, packing elements such as rings or saddles, structured packing, or combinations thereof. In one or more embodiments, the one or more separators 350 can be an open column without internals. In one or more embodiments, the one or more separators 350 can be one or more partially empty columns containing one or more internal structures. In one or more embodiments, the one or more separators 350 can operate at a temperature of about 15° C. to about 600° C., about 15° C. to about 500° C., or about 15° C. to about 400° C. In one or more embodiments, the one or more separators 350 can operate at a pressure of about $P_{C,S}$−700 kPa to about $P_{C,S}$+2,100 kPa, about $P_{C,S}$−500 kPa to about $P_{C,S}$+1,500 kPa, or about $P_{C,S}$−300 kPa to about $P_{C,S}$+700 kPa.

In one or more embodiments, at least a portion of the concentrated DAO mixture in line 358 can be directed to the one or more strippers 360 and selectively separated therein to provide a recovered solvent via line 362 and a DAO solution via line 102. In one or more embodiments, the recovered solvent in line 362 can contain a first portion of the solvent, and the DAO product in the line 102 can contain a DAO solution including DAO and the balance of the solvent. In one or more embodiments, the recovered solvent in line 362 can have a solvent concentration ranging from about 70 wt % to about 100 wt %, about 85 wt % to about 99.9 wt %, or about 90 wt % to about 99.9 wt % or more, with the DAO providing the balance.

In one or more embodiments, the DAO solution in line 102 can have a DAO concentration ranging from about 50 wt % to about 100 wt %, from about 60 wt % to about 90 wt %, from about 70 wt % to about 80 wt %, or about 77 wt %, with the solvent substantially providing the balance. In one or more embodiments, the specific gravity at 15.6° C. of the DAO solution in line 102, which can be connected with the FCC 101, as shown in FIGS. 1 and 2, can range from about 0.5 to about 1.5, about 0.7 to about 1.3, about 0.9 to about 1.0, about 0.96 to about 0.98, or about 0.9790°.

In one or more embodiments, steam, for example saturated or superheated, can be introduced via line 364 to the stripper 360 to further enhance the separation of the DAO from the solvent. In one or more embodiments, the steam in line 364 can be at a pressure ranging from about 200 kPa to about 2,160 kPa, from about 300 kPa to about 1,375 kPa, or from about 400 kPa to about 1,130 kPa.

The one or more strippers 360 can include one or more systems, devices, or combination of systems and/or devices suitable for separating the concentrated DAO mixture in line 358 to provide the recovered solvent via line 362 and the DAO solution via line 102, which can be transported to the FCC 101, as described above with reference to FIGS. 1 and 2. In one or more embodiments, the one or more strippers 360 can contain one or more internal structures including, but not limited to bubble trays, packing elements such as rings or saddles, structured packing, or combinations thereof. In one or more embodiments, the one or more strippers 360 can be an open column without internals. In one or more embodiments, the one or more strippers 360 can be one or more partially empty columns containing one or more internal structures. In one or more embodiments, the one or more strippers 360 can operate at a temperature of about 15° C. to about 600° C., about 15° C. to about 500° C., or about 15° C. to about 400° C. In one or more embodiments, the pressure in the one or more strippers 360 can operate at close to zero pressure, for example at about 0.1 kPa. In one or more embodiments, the one or more strippers 360 can operate at a pressure ranging from a low of about 30 kPa, about 100 kPa, about 500 kPa, or about 1,000 kPa to a high of about 2,500 kPa, about 3,300 kPa, about 4,000 kPa, or about 4,500 kPa.

In one or more embodiments, at least a portion of the recovered solvent in lines 332 and 362 can be combined to provide a recycled solvent via line 338. Although not shown, at least a portion of the recovered solvent in line 352 can be combined with at least a portion of the recovered solvent in line 332 and/or at least a portion of the recovered solvent in line 362 to provide the recycled solvent in line 338. In one or more embodiments, the recycled solvent in line 338 can be a two phase mixture containing both liquid and vapor. In one or more embodiments, the temperature of the recycled solvent in line 338 can range from about 30° C. to about 600° C., about 100° C. to about 550° C., or about 300° C. to about 500° C.

In one or more embodiments, the recycled solvent in line 338 can be condensed using the one or more condensers 335, to provide a condensed solvent in line 339. In one or more embodiments, the cooled solvent in line 339 can have a temperature ranging from a low of about 10° C., about 20° C., or about 30° C. to a high of about 100° C., about 200° C., about 400° C., or more. The solvent concentration in line 339 can range from a low of about 80 wt %, about 85 wt %, or about 90 wt % to a high of about 95 wt %, about 98 wt %, about 99 wt %, or more.

The one or more condensers 335 can include one or more systems, devices, or combination of systems and/or devices suitable for decreasing the temperature of the recycled solvent in line 338 to provide a condensed solvent via line 339. In one or more embodiments, the condenser 335 can include, but is not limited to liquid or air cooled shell-and-tube, plate and frame, fin-fan, and/or spiral wound cooler designs. In one or more embodiments, a cooling medium such as water, refrigerant, air, or combinations thereof can be used to remove the necessary heat from the recycled solvent in line 338. In one or more embodiments, the one or more condensers 335 can operate at a temperature of about −20° C. to about $T_{C,S}$° C., about −10° C. to about 300° C., or about 0° C. to about 300° C. In one or more embodiments, the one or more condensers 335 can operate close to zero pressure, for example at about 0.1 kPa. In one or more embodiments, the one or more condensers 335 can operate at a pressure of about 30 kPa to about $P_{C,S}$+700 kPa, or about 100 kPa to about $P_{C,S}$+500 kPa, or about 100 kPa to about $P_{C,S}$+300 kPa.

In one or more embodiments, at least a portion of the condensed solvent in line 339 can be stored in the one or more reservoirs 340. At least a portion of the solvent in the one or more reservoirs 340 can be recycled via line 386 using one or more pumps 392. The recycled solvent in line 386 can be combined with at least a portion of the recovered solvent in line 352 to provide a solvent recycle via line 377. A first portion of the solvent recycle in line 377 can be recycled to the mixer 310.

A second portion of the solvent in line 377 can be recycled via line 378 to one or more external systems, for example one or more solvent dewatering systems (not shown). The temperature of the recycled solvent in line 378 can be adjusted by passing an appropriate amount of a heating or cooling medium through one or more heat exchangers 375. In one or more embodiments, the solvent in line 378 or 379, depending upon whether the heat exchanger 375 is used, can have a temperature ranging from a low of about 10° C., about 20° C., or about 30° C. to a high of about 100° C., about 200° C., about 400° C., or more.

The one or more heat exchangers 375 can include liquid or air cooled shell-and-tube, plate and frame, fin-fan, or spiral wound cooler designs. In one or more embodiments, the one or more heat exchangers 375 can operate at a temperature of about −20° C. to about $T_{C,S}$° C., about −10° C. to about 300° C., or about 0° C. to about 300° C. In one or more embodiments, the one or more condensers 375 can operate can operate at close to zero pressure, for example at about 0.1 kPa. In one or more embodiments, the one or more condensers 375 can operate at a pressure of about 30 kPa to about $P_{C,S}$+700 kPa, or about 100 kPa to about $P_{C,S}$+500 kPa, or about 100 kPa to about $P_{C,S}$+300 kPa.

In one or more embodiments, the asphaltene product in line 333 can be introduced to one or more post treatment processes 390 to provide one or more finished asphaltene products via line 363. With additional reference to FIGS. 1 and 2, in one or more embodiments, all or a portion of the asphaltene product in line 333 can be combusted in one or more combustion and/or heat recovery systems 390 to provide heat and/or steam to the ADU 310, the VDU 320, the steam in line 118, and/or the catalytic cracking system 100. In one or more embodiments, the steam can be used to provide at least a portion of the thermal energy required in the solvent extraction system 230, to provide at least a portion of the steam required for stimulation of additional crude hydrocarbons, for example through SAGD, to provide at least a portion of the electrical energy required, for example through the use of one or more steam turbine generators, or any combination thereof.

In one or more embodiments, all or a portion of the asphaltene product in line 333 can be introduced to one or more treatment processes 390 to provide one or more finished asphaltene products via line 363. In one or more embodiments, the treatment process 390 can include pelletizing all or a portion of the asphaltenes present in the asphaltene product in line 333. Various pelletization processes are described in U.S. Pat. Nos. 7,101,499; 6,499,979; 6,361,682; 6,331,245; 4,931,231 and 3,847,751, the entirety of each being incorporated herein by reference to the extent not inconsistent with this disclosure. In one or more embodiments, at least a portion of the asphaltene product introduced via line 333 to the treatment process 390 can be used to produce one or more hydrocarbon based catalysts via line 363. Various processes for the production of one or more hydrocarbon catalysts are disclosed in U.S. Pat. Nos. 5,288,681 and 5,171,727, the entirety of both being incorporated herein by reference to the extent not inconsistent with this disclosure. In one or more embodiments, at least a portion of the asphaltene product introduced via line 333 to the treatment process 390 can be used to produce one or more asphalt based building products. A process for the production of asphalt building products is disclosed in U.S. Pat. No. 6,899,839, the entirety of which is incorporated herein by reference, to the extent not inconsistent with this disclosure. In one or more embodiments, at least a portion of the asphaltene product introduced to the treatment process 390 can be gasified to produce hydrogen, carbon monoxide, carbon dioxide, or any combination thereof via line 363. A process for the gasification of an asphaltenic hydrocarbon is disclosed in U.S. Pat. No. 6,773,630, the entirety of which is incorporated herein by reference, to the extent not inconsistent with this disclosure. In one or more embodiments, at least a portion of the asphaltene product introduced via line 333 to the treatment process 390 can be converted to provide one or more olefins via line 363. A process for the conversion of an asphaltenic hydrocarbon to olefins is disclosed in U.S. Pat. No. 6,303,842, the entirety of which is incorporated herein by reference, to the extent not inconsistent with this disclosure.

EXAMPLES

The foregoing discussion can be further described with reference to the following non-limiting examples.

With reference to FIGS. 1-3, as shown in Table 1, the DAO derived from vacuum residue has relatively higher viscosity and temperature boiling points ("TBP") when compared to hydrodesulphurised atmospheric residue typical of that processed in FCC units designed for residue processing. In the example shown in Table 1, the DAO from vacuum residue is derived from Arab light crude, which is distilled at least in a VDU such as VDU 220, with residue de-asphalted by the solvent extraction system 230. The vaporization of the hydrocarbon derived from vacuum residue can present challenges in an FCC 101 having a riser 120 with an operating temperature, for example, under 550° C., as the majority of the DAO derived from the vacuum residue has a boiling point above this operating temperature. Moreover, atomization through, for example, a spray nozzle, is reduced by the high viscosity. Furthermore, at such high viscosity, directing the hydrocarbon through the line 102 and through any devices attached thereto can present difficulties.

TABLE 1

| Property | Unit | Hydrodesulphurised Atmospheric Residue | DAO Derived from Vacuum Residue |
|---|---|---|---|
| Density at 15° C. | g/cm$^3$ | 0.9331 | 0.9790 |
| Sulphur | wt % | 0.4 | 3.5 |
| Conradson Carbon Residue | wt % | 5.0 | 8.0 |
| TBP by Vol % | | | |
| IBP (1%) | ° C. | 335 | 400 |
| 5 | ° C. | 374 | 502 |
| 10 | ° C. | 392 | 528 |
| 30 | ° C. | 443 | 589 |
| 50 | ° C. | 493 | 645 |
| 70 | ° C. | 561 | 732 |
| 90 | ° C. | 686 | >800 |
| 95 | ° C. | 745 | >800 |
| FBP | ° C. | 800 | >800 |
| Vanadium Content | Ppmw | 9 | 8 |
| Nickel Content | Ppmw | 7 | 3 |
| Viscosity | | | |
| Viscosity @ 40° C. | cSt | 500 | 8,000 |
| Viscosity @ 50° C. | cSt | 180 | 3,000 |
| Viscosity @ 99° C. | cSt | 25 | 153 |
| Viscosity @ 135° C. | cSt | 9 | 40 |

Accordingly, steam can be injected into or otherwise combined with the hydrocarbon prior to entry into the riser 120, as described above, to reduce the partial pressure of the hydrocarbon in the riser 120. Furthermore, hydrocarbon products of the FCC 101, examples of which are presented in Table 2 and 3, can be mixed, for example, via line 114 and/or line 116 with the hydrocarbon in line 102.

TABLE 2

| Parameters | Unit | Light Naphtha | Heavy Naphtha |
|---|---|---|---|
| Cut range | ° C. | C5-90° C. | 90-224° C. |
| Density at 15° C. | g/cm$^3$ | 0.6912 | 0.7929 |
| Distillation (Vol %) | | | |
| 10 | ° C. | 43 | 74 |
| 30 | ° C. | 53 | 90 |
| 50 | ° C. | 58 | 118 |
| 70 | ° C. | 63 | 138 |
| 90 | ° C. | 72 | 159 |
| 95 | ° C. | 75 | 190 |
| FBP | ° C. | 78 | 209 |

TABLE 3

| Properties | Unit | Light Cycle Oil | Clarified Oil |
|---|---|---|---|
| Density at 15° C. | g/cm$^3$ | 0.9659 | 1.0517 |
| API Gravity | ° | 15.0 | 3.04 |
| Distillation (Vol %) | | | |
| IBP | ° C. | 196 | 282 |
| 10 | ° C. | 217 | 383 |
| 30 | ° C. | 249 | 423 |
| 50 | ° C. | 283 | 470 |
| 70 | ° C. | 319 | 528 |
| 90 | ° C. | 358 | 648 |
| FBP | ° C. | 381 | 694 |
| CCR (10% distillation residue) | wt % | (0.074) | 7.0 |
| Pour Point | ° C. | −13 | 10 |
| Kinetic viscosity at 40° C. | cSt | 5.0 | 246 |
| Kinetic viscosity at 100° C. | cSt | | 9 |

The result of combining the hydrocarbon products with the hydrocarbon in line 102 can result in a combined hydrocarbon having properties that maximize the yield of the desired products from the FCC 101. For example, the combined hydrocarbon can have a boiling range, viscosity and carbon residue content that are generally in-line with that of a traditional residue FCC feedstock. Table 4 provides estimated blending calculation results for the blending of the vacuum residue derived DAO with two different fractions of light cycle oil via line 114. In one embodiment, the recycled hydrocarbon mixture includes about 47.3 vol % light cycle oil and in the second case the mixture includes about 37.5 vol % light cycle oil. The first case provides a combined feed with a 50 vol % boiling point similar to that of a traditional residue FCC feedstock, while the second case provides a blending of DAO and light cycle oil having carbon residue and viscosity values generally more similar to that of the traditional residue FCC feedstock.

TABLE 4

| Property | Unit | Hydrodesulphurised Atmospheric Residue | CASE 1: Approx. 47.3% LCO Blend | CASE 2: Approx. 37.5% LCO Blend |
|---|---|---|---|---|
| Percentage LCO in Blend | wt % | | 47.3 | 37.5 |
| Density at 15° C. | g/cm$^3$ | 0.9331 | 0.9720 | .971 |
| Sulphur | wt % | 0.4 | 2.2 | 2.4 |
| Conradson Carbon Residue | wt % | 5.0 | 4.1 | 4.8 |
| TBP by Vol % | | | | |
| IBP (1%) | ° C. | 335 | 198 | 198 |
| 5 | ° C. | 374 | 218 | 223 |
| 10 | ° C. | 392 | 234 | 247 |
| 30 | ° C. | 443 | 306 | 351 |
| 50 | ° C. | 493 | 493 | 566 |
| 70 | ° C. | 561 | 624 | 663 |
| 90 | ° C. | 686 | 784 | 799 |
| 95 | ° C. | 745 | >800 | >800 |

TABLE 4-continued

| Property | Unit | Hydrodesulphurised Atmospheric Residue | CASE 1: Approx. 47.3% LCO Blend | CASE 2: Approx. 37.5% LCO Blend |
|---|---|---|---|---|
| FBP | ° C. | 800 | >800 | >800 |
| Vanadium Content | ppmw | 9 | 4.0 | 4.8 |
| Nickel Content | ppmw | 7 | 1.5 | 1.8 |
| Viscosity | | | | |
| Viscosity @ 40° C. | cSt | 500 | 110 | 661 |
| Viscosity @ 50° C. | cSt | 180 | 51 | 240 |
| Viscosity @ 99° C. | cSt | 25 | 7 | 14 |
| Viscosity @ 135° C. | cSt | 9 | 3.5 | 5.6 |

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method for processing a hydrocarbon, comprising:

combining a hydrocarbon comprising a de-asphalted oil with a recycled hydrocarbon product to produce a combined hydrocarbon, wherein the de-asphalted oil has a 50 vol % distillation temperature of about 625° C. to about 750° C.;

contacting the combined hydrocarbon with a catalyst, wherein the hydrocarbon and the recycled hydrocarbon are combined prior to contacting the catalyst;

cracking the combined hydrocarbon consisting essentially of the hydrocarbon and the recycled hydrocarbon in the presence of the catalyst to produce a cracked hydrocarbon product and a coked catalyst;

recovering the cracked hydrocarbon product from the coked catalyst to produce a recovered hydrocarbon product consisting essentially of the cracked hydrocarbon product;

fractionating the recovered hydrocarbon product to produce a cycle oil product, a light naphtha product, and a heavy naphtha product, wherein the heavy naphtha product comprises $C_7$-$C_{12}$ hydrocarbons and wherein the heavy naphtha product has a final boiling point of about 195° C. to about 220° C., a 10 vol % distillation temperature of about 60° C. to about 90° C., and a 50 vol % distillation temperature of about 105° C. to about 130° C.; and recycling the heavy naphtha product to provide the recycled hydrocarbon product.

2. The method of claim 1, wherein the cycle oil is a light cycle oil, a heavy cycle oil, an intermediate cycle oil, a slurry oil, a clarified oil or a decanted oil.

3. The method of claim 1, wherein the cycle oil product has a density at about 15° C. of from about 0.8 g/cm$^3$ to about 1.1 g/cm$^3$.

4. The method of claim 1, wherein the heavy naphtha product has a density at about 15° C. of from about 0.6 g/cm$^3$ to about 0.9 g/cm$^3$ and wherein the recycle hydrocarbon product consists of the heavy naphtha product.

5. The method of claim 1, wherein the combined hydrocarbon comprises from about 25 wt % to about 55 wt % of the recycled hydrocarbon.

6. The method of claim 1, wherein the de-asphalted oil has a viscosity from about 5,000 cSt to about 8,500 cSt at 40° C. and the combined hydrocarbon has a 50 vol % distillation temperature that is less than about 600° C.

7. The method of claim 6, wherein the combined hydrocarbon has a viscosity at about 40° C. of from about 100 cSt to about 675 cSt.

8. The method of claim 1, further comprising introducing steam to the combined hydrocarbon to produce a mixture comprising from about 5 wt % to 10 wt % steam.

9. The method of claim 1, wherein the recycled hydrocarbon product has a final boiling point of from about 350° C. to about 400° C.

10. The method of claim 1, wherein the recycled hydrocarbon product further comprises a clarified oil having a density of from about 0.9 g/cm$^3$ to about 1.15g/cm$^3$.

11. The method of claim 1, wherein the de-asphalted oil has an initial boiling point of from about 375° C. to about 425° C., a final boiling point above about 800° C., a viscosity of from about 1,000 cSt to about 100,000 cSt at 40° C. and a Conradson Carbon Residue of from about 3.0 wt % to about 14.0 wt %.

12. The method of claim 11, wherein the combined hydrocarbon has a viscosity that is less than about 50% of the viscosity of the de-asphalted oil.

13. The method of claim 1, wherein the combined hydrocarbon has a 50 vol% distillation temperature of about 400° C. to about 575° C., and wherein the combined hydrocarbon is cracked at a temperature of about 400° C. to about 600° C. to produce the cracked hydrocarbon product.

14. A method for processing a hydrocarbon, comprising:

contacting a de-asphalted oil recovered from vacuum tower bottoms and a heavy naphtha product with a catalyst;

cracking the de-asphalted oil and the heavy naphtha product in the presence of the catalyst to produce a cracked hydrocarbon product and a coked catalyst;

recovering the cracked hydrocarbon product from the coked catalyst to produce a recovered hydrocarbon product consisting essentially of the cracked hydrocarbon product;

fractionating the recovered hydrocarbon product to produce the heavy naphtha product, wherein the heavy naphtha product comprises $C_7$-$C_{12}$ hydrocarbons and wherein the heavy naphtha product has a final boiling point of about 195° C. to about 220° C., a 10 vol% distillation temperature of about 60° C. to about 90° C., a 50 vol% distillation temperature of about 105° C. to about 130° C., and a density of from about 0.6 g/cm$^3$ to about 0.9g/cm$^3$;

combining the heavy naphtha product with the de-asphalted oil prior to cracking the de-asphalted oil to produce a combined hydrocarbon consisting essentially of the de-asphalted oil and the heavy naphtha product, wherein the cracked hydrocarbon product is produced from cracking essentially the combined hydrocarbon, and wherein the de-asphalted oil has a 50 vol % distillation temperature of about 625° C. to about 750° C.; and mixing steam with the de-asphalted oil prior to cracking the de-asphalted oil.

15. The method of claim 14, further comprising:

fractionating the recovered hydrocarbon product to produce a light cycle oil having a density of from about 0.8 g/cm$^3$ to about 1.1 g/cm$^3$; and combining the heavy naphtha product and the light cycle oil with the de-asphalted oil prior to cracking the de-asphalted oil.

16. The method of claim 14, wherein, after combining the heavy naphtha product with the de-asphalted oil, a resulting combined hydrocarbon comprises from about 35 wt % to about 50 wt % of the hydrocarbon product.

* * * * *